United States Patent [19]

Ota

[11] 4,120,229

[45] Oct. 17, 1978

[54] ELECTRONIC TUNER

[75] Inventor: Kyozo Ota, Fuchu, Japan

[73] Assignee: Keio Giken Kogyo Kabushiki Kaisha, Tokyo, Japan

[21] Appl. No.: 643,054

[22] Filed: Dec. 22, 1975

[30] Foreign Application Priority Data

Dec. 30, 1974 [JP] Japan ..... 50-1813

[51] Int. Cl.[2] ..... G10G 7/02

[52] U.S. Cl. ..... 84/454; 84/1.01; 324/79 R

[58] Field of Search ..... 84/454, 1.01; 324/78 R, 324/78 Z, 78 J, 78 N, 79 R, 79 D, 83 R, 83 A

[56] References Cited

U.S. PATENT DOCUMENTS

| | | | |
|---|---|---|---|
| 3,722,353 | 3/1973 | Westhaver | 324/79 R |
| 3,795,169 | 3/1974 | Belcher | 84/454 |
| 3,878,754 | 4/1975 | Barnum | 84/454 |
| 3,881,389 | 5/1975 | Allen | 84/454 |
| 3,901,120 | 8/1975 | Youngquist | 84/454 |
| 3,948,140 | 4/1976 | Ichioka et al. | 84/454 |

*Primary Examiner*—Robert K. Schaefer
*Assistant Examiner*—Vit W. Miska
*Attorney, Agent, or Firm*—Pollock, Vande Sande and Priddy

[57] ABSTRACT

An electronic tuner for musical instruments is disclosed which has built therein a voltage-controlled reference oscillator having its oscillation frequency controlled by a control signal and in which the oscillation signal of the reference oscillator and an input musical sound signal from a microphone are phase compared by a phase comparator and the oscillator is controlled by the phase compared output so that its oscillation frequency is synchronized with the frequency of the input musical sound signal. A control voltage, which is obtained when the oscillation frequency of the reference oscillator is synchronized with the frequency of the input musical sound signal, is applied to an indicator to indicate the ratio between the two frequencies.

8 Claims, 17 Drawing Figures

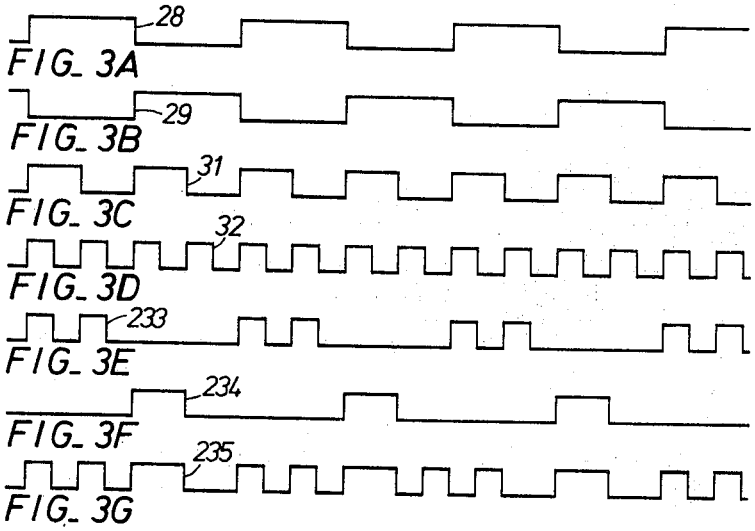
28
FIG. 3A
29
FIG. 3B
31
FIG. 3C
32
FIG. 3D
233
FIG. 3E
234
FIG. 3F
235
FIG. 3G
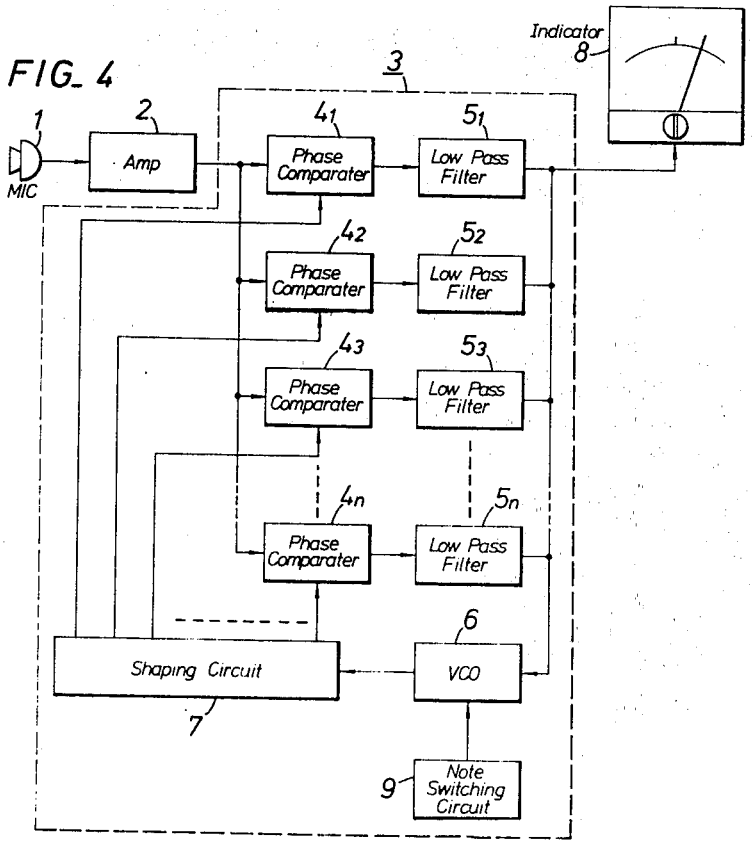
FIG. 4
Indicator
8
3
1
MIC
2
Amp
4₁
Phase Comparater
5₁
Low Pass Filter
4₂
Phase Comparater
5₂
Low Pass Filter
4₃
Phase Comparater
5₃
Low Pass Filter
4n
Phase Comparater
5n
Low Pass Filter
6
Shaping Circuit
VCO
7
9
Note Switching Circuit Note Switching Circuit
VCO
Low Pass Filter
Phase Comparator
Indicator
DC-DC Converter
Shaping Circuit
Amp

ELECTRONIC TUNER

BACKGROUND OF THE INVENTION

This invention relates to an electronic tuner for musical instruments, and more particularly to an electronic tuner for detecting and indicating whether or not the frequency of a sound given forth from a musical instrument is deviated from the standard tuning frequency of the particular musical sound and, if deviated, how much it is deviated.

In general, musical sounds or notes are defined according to frequency, so that the frequency of any particular musical sound or note should not differ with musical instruments. However, it is difficult to maintain the musical instruments in their correctly tuned condition. For example, pianos, guitars (except steel guitars) and the like can be played with correct musical intervals for a certain period of time once they are tuned. On the other hand notes given off, by string instruments such as a violin, a steel guitar, etc. and wind instruments appreciably differ with players.

Accordingly, it is necessary to tune the instruments used in orchestras, brass bands and so on. Tuners are employed for such tuning. Heretofore, various types of tuners have been manufactured and sold and one that has been in relatively wide use is a tuner commercially known under the name of "Strobo CONN", manufactured by Conn Inc. of U.S.A. In this tuner, 12 windows are formed in the surface of a panel and, behind these windows, strobe discs are disposed which are coupled together by means of gears and rotate in predetermined ratios to one another. And these strobo discs are positioned so that they can be partly seen through the windows, respectively. One surface of each strobe disc has formed thereon black and white striped patterns at predetermined intervals in the rotational direction of the disc and the striped patterns are irradiated by light of a discharge tube which is turned on and off at the frequency of a particular musical sound. When the striped patterns are seen as if stopped, it is judged that the sound is correct. The 12 windows respectively correspond to the notes C to B of one octave and have formed thereon striped patterns arranged in integral multiple relationships, with which tuning of notes of different octaves is achieved.

This type of tuner is so constructed as to drive the plurality of discs with one motor, and hence has such disadvantages as complexity in construction and expensiveness.

In a modified form of this type of tuner, the number of windows are reduced to one and instead the number of revolutions of the motor is changed by a changeover switch in a stairstep manner in accordance with each particular note, thereby changing the strobe frequency. In some cases, a cathode ray tube is employed as the indicating means. Namely, on the screen of the cathode ray tube, a strip-like bright line is normally displayed at a sweep speed of the frequency corresponding to each note. An electron beam is brightness modulated by the sound given off by a musical instrument and when the frequency of the sound is synchronized with the sweep speed defined by the switch, the bright line becomes a broken line and is seen as if stopped. When the frequency of the musical sound is a little deviated from the defined frequency, the broken line moves to right or left. Depending upon whether the broken line moves to right or left, it is judged whether the frequency of the musical sound is deviated upwardly or downwardly. However, this type of tuner employs the cathode ray tube, and hence is expensive.

Another conventional type of tuner employs a lamp as the indicating means so as to reduce the manufacturing cost. In this tuner, a plurality of lamps are aligned in line and normally turned on and off one after another at high speed, that is scanned in such a manner as if they are all lighted simultaneously. When a musical sound is given forth, if its frequency is equal to the scanning speed selected by a changeover switch, only one lamp, for example, the center one is lighted. Where the frequency of the musical sound is deviated upwardly or downwardly, the lamps are lighted in a sequential order from right to left or left to right and the direction of the lighting indicates the direction of the frequency deviation. This tuner has an advantage of low manufacturing cost.

With these conventional tuners, however, the direction of the frequency deviation is indicated first and, in order to detect the amount of frequency deviation, it is necessary. for example, in the case of the tuner employing the strobe disc, to adjust a motor speed adjusting knob until the striped pattern of the window corresponding to the note of the musical sound stops and then to read a rotary scale of the knob. In the case of the tuner employing the cathode ray tube, too, it is necessary to adjust a sweep speed fine control knob to stop the displayed broken line. And, also in the case of the tuner using the lamps, it is required to adjust a lamp switching speed adjusting knob to stop the lamp lighting position at the center.

In the practical tuning of a musical instrument, the player is required to tune the instrument in accordance with the amount of the frequency deviation obtained by himself while handling the instrument at the same time. Consequently, it is inconvenient for him to adjust the adjusting knobs, too. Further, in the case of musical sounds of high frequencies, the frequency difference is likely to be large, so that, if such a sound is out of tone, the flow of the striped pattern of the strobe disc, the broken line displayed on the cathode ray tube or the lamp indication is very fast and the direction of the frequency deviation is difficult to judge. In the case of low-frequency sounds, the frequency difference is not so large, and consequently even if such a sound is not correct, the flow of the striped pattern of the strobe disc, the broken line on the cathode ray tube or the lamp indication is slow, and hence its indication cannot be recognized immediately.

One object of this invention is to provide an electronic tuner which is adapted for a direct-reading indication of the amount of frequency deviation of a musical sound.

Another object of this invention is to provide an electronic tuner which furnishes a direct-reading indication of the amount of frequency deviation of a musical sound requiring the player only to produce the sound from his musical instrument.

Another object of this invention is to provide an electronic tuner which is designed to indicate the ratio between the frequency of a musical sound and that of a reference oscillator and wherein, whether the frequency of the sound is high or low, the amount of deviation can be directly indicated by a scale graduated in percent.

Another object of this invention is to provide an electronic tuner which employs a switch for changing over the oscillation frequency of a reference oscillator to the frequencies of each scale, and hence enables tuning for 12 notes of each scale.

Another object of this invention is to provide an electronic tuner in which higher harmonics that are an even-number times a reference signal supplied to a phase comparator are superimposed upon the reference signal to enable tuning at one set position for each particular note of several octaves.

Another object of this invention is to provide an electronic tuner which is capable of correctly indicating the frequency of a musical sound even if the oscillation frequency of a reference oscillator drifts due to a temperature change or the like.

Another object of this invention is to provide an electronic tuner which is capable of selectively changing a standard frequency for tuning to 440, 435 and 445Hz.

Still another object of this invention is to provide an electronic tuner which employs digital indicating means to facilitate the reading of an indication.

SUMMARY OF THE INVENTION

The electronic tuner according to this invention has housed in its case a microphone for converting a musical sound into an electric signal, a low-frequency amplifier for amplifying the converted musical sound, a voltage-controlled variable frequency oscillator having its oscillation frequency controlled by a control voltage, a phase comparator, a low-pass filter connected to the output side of the phase comparator and an indicator for indicating the output voltage from the low-pass filter. The musical sound signal derived from the low-frequency amplifier and the oscillation signal of the reference oscillator are compared in phase with each other and the output from the phase comparator is applied through the low-pass filter to the indicator and a frequency control terminal of the reference oscillator. By the compared output, the oscillation frequency of the reference oscillator is synchronized with the frequency of the input musical sound signal, and the compared output, obtained when they are synchronized with each other, is indicated by the indicator.

The voltage-controlled oscillator, the phase comparator and the low-pass filter make up a phase lock loop (usually called PLL) and a control voltage necessary for its phase locking operation is indicated by the indicator, by which the ratio between the frequency of the input musical sound signal and the oscillation frequency of the reference oscillator is indicated. Accordingly, in the present invention, a direct-reading indication of the ratio between the frequency of the input musical sound signal and the oscillation frequency of the reference oscillator can be provided on the indicator only by giving forth the sound from the musical instrument. In addition, since the phase lock loop is used, the frequency selecting characteristic is extremely sharp and a slight frequency difference of any sound can be discriminated to enable accurate tuning. Moreover, the tuner of this invention does not employ any mechanical parts unlike Strobo CONN, and hence is stable, highly reliable, long-lived and inexpensive.

BRIEF DESCRIPTION OF THE DRAWINGS

FIGS. 3A–3G show a series of wave-form diagrams for explaining its operation;

FIG. 4 is a system diagram showing another example of this invention;

DESCRIPTION OF THE PREFERRED EMBODIMENTS

Figure 1:
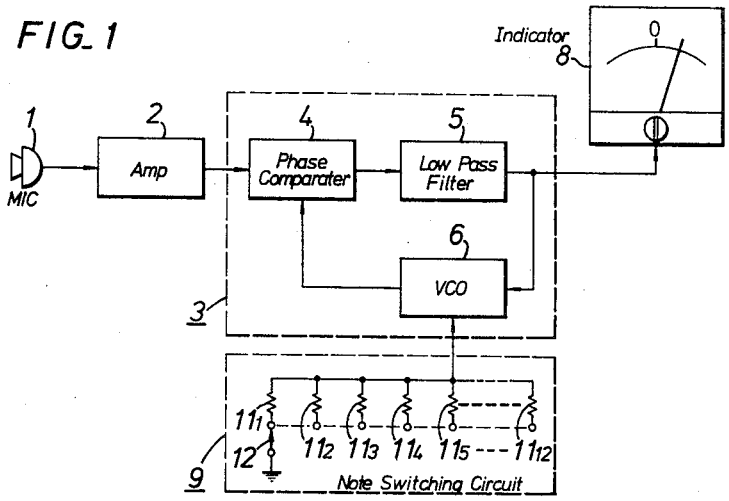
FIG. 1 is a system diagram showing one example of an electronic tuner constructed in accordance with the present invention.

In FIG. 1, reference numeral 1 indicates a microphone for converting an incoming musical sound or tone into an electric signal. The input musical sound signal converted by the microphone 1 into the electric signal is amplified by a low-frequency amplifier 2, the amplified output of which is supplied to a phase lock loop 3. As is known in the art, the phase lock loop 3 is composed of a phase comparator 4, a low-pass filter 5 for smoothing the output signal from the phase comparator 4 and a voltage-controlled reference oscillator 6 (hereinafter indicated by VCO6) whose oscillation frequency is controlled by a deviation voltage signal derived at the output side of the low-pass filter 5. The input musical sound signal received by the microphone 1 and the oscillation signal of the oscillator VCO6 are compared in phase by the phase comparator 4. By the resulting compared output, the oscillation frequency of the oscillator VCO6 is controlled and the oscillation frequency and phase of the oscillator VCO6 are respectively locked at the frequency and in the phase of the input musical sound signal. And the deviation voltage value necessary for the locking is indicated by an indicator 8. The deviation voltage is in proportion to the frequency ratio between the input musical sound signal and the oscillation signal and the indicator 8 provides an indication of a value corresponding to the frequency ratio between the input musical sound signal and the oscillation signal of the oscillator VCO6.

The oscillator VCO6 is provided with a note switching circuit 9. In the note switching circuit 9 of this example, the resistance values of resistors $\mathbf{11}_1$ to $\mathbf{11}_{12}$ of a time constant circuit for determining the oscillation frequency of the oscillator VCO6 are selected so that by selectively changing over the resistors $\mathbf{11}_1$ to $\mathbf{11}_{12}$ with a switch 12, the oscillation frequency of the oscillator VCO6 may be changed over to any one of the standard tuning frequencies of 12 notes C, C#, D, D#, E, F, F#, G, G#, A, A# and B. That is, the switching position of the switch 12 is selected depending upon the sound to be tuned and the indicator 8 indicates the amount of deviation of the musical sound from a correct note at that position. A double deflection zero center type meter can be employed as the meter 8. The meter is graduated in in percent (which indicates the whole tone with 200 graduations) and, in this case, positive and negative graduations are respectively provided to the right and left of the zero position. A deflection of the pointer to the positive side indicates that the frequency of the input musical sound signal is higher than the standard tuning frequency and a deflection to the negative side indicates that the frequency of the input musical sound is lower than the standard tuning frequency. In practice, full scales of ±50 percent are provided to the right and left of zero and the meter is adapted to deflect to the full scale when the input musical sound signal is deviated ±¼ tone from the standard value.

As is seen from the fact that the phase lock loop has an extremely narrow frequency selecting characteristic about the oscillation frequency of the oscillator VCO6 as is well-known in the art, the frequency of each sound of the input musical sound signal can be discriminated by the phase lock loop from the others with high accuracy. Accordingly, with the use of the phase lock loop as the frequency comparing means of the tuner, as in the present invention, there are no possibilities of the tuner responding to other sounds than that set by the tuner itself. Further, if the oscillation frequency of the oscillator VCO6 is accurately set at the standard tuning frequency of each scale note, it is possible to detect a frequency deviation of the musical sound signal from the standard value with accuracy. Moreover, since the frequency deviation of the musical sound signal from the standard tuning frequency is directly indicated on the indicator 8, there is no need for a player using the tuner to make any tune adjustments, such as an adjustment of strobe frequency changing means for finding the amount of frequency deviation as in a conventional tuner. This permits a player of a musical instrument to devote himself to tuning of the musical instrument, and hence enables rapid tuning.

Tuning of only one sound is insufficient for the tuning of a musical instrument and it is necessary to tune the musical instrument over one octave or all over the scale notes obtainable with the musical instrument, as shown in the FIG. 1 example. To this end, the note switching circuit 9 is provided in association with the oscillator VCO6 for selectively switching the respective scales. For changing the scale notes to be tuned, switching of the oscillation frequency of the oscillator VCO6 actuating the switch 12 of the note switching circuit 9 and playing of the musical instrument are achieved alternately with each other. Accordingly, there are some occasions when the scale note selectively designated by the switch 12 and the sound produced by the musical instrument do not correspond to each other for some reason. For example, there is the likelihood that although the switch 12 is positioned to select the note C, the player produces a sound D in the mistaken belief that the switch 12 is actually connected to select the note D. In such a case, since the difference between the oscillation frequency of the oscillator VCO6 and the frequency of the sound of the musical instrument is large, the signal supplied to the low-pass filter 5 becomes of high-frequency components. The high-frequency components cannot pass through the low-pass filter 5, so that the output voltage from the low-pass filter 5 does not undergo any change and the pointer of the indicator 8 remains to register zero.

In short, even if a wrong sound is produced, the indicator 8 indicates zero. Accordingly, even in the case of such a wrong sound being produced, there is the fear of judging erroneously that the sound has the standard tuning frequency. This problem can be solved, for example, by arranging the indicator 8 so that its pointer is normally biased in one direction and that when the musical sound signal agrees with the standard value, the pointer then registers zero. With such an arrangement, the pointer of the indicator 8 deflects only when the frequency of the musical sound is inside of a certain frequency range about the standard tuning frequency of the note selected for tuning. And when sounds other than the selected one are produced, the pointer does not move, so that the player can immediately recognize his error. For biasing the pointer of the indicator 8, it is sufficient only to previously deviate the oscillation frequency of the oscillator VCO6, for example, by 50 percent downwardly (or upwardly) of the standard value of each scale note. This can be achieved by a method of selecting such a resistance value of each of the resistors $\mathbf{11}_1$ to $\mathbf{11}_{12}$ as to provide such a frequency or superimposing a bias voltage on a deviation signal supplied to the oscillator VCO6.

Accordingly, in the case where the oscillation frequency of the oscillator VCO6 is deviated, for example, about 50 percent downwardly of the standard value, the pointer of the indicator 8 normally deflects to the position of −50 percent. And when the tuner is supplied with a musical sound signal having the standard tuning frequency of the note being selected, the indicator 8 registers zero. In the case of a musical sound signal having a frequency deviation of 50 percent higher than the standard value, the indicator 8 indicates +50 percent and in the case of a musical sound signal having a frequency deviation of 50 percent lower than the standard value, the indicator 8 indicates −50 percent. Consequently, in the case of a frequency deviation of more than 50 percent lower than the standard value, the pointer does not move but the frequency deviation of the musical sound signal from the standard tuning frequency of the note being selected is known. In practice, it is sufficient only to adopt full scales of about ±70 to 80 percent and to deviate the frequency of the oscillator VCO6 by a value corresponding to the full scale of one side. Accordingly, by deviating the oscillation frequency of the oscillator VCO6 by a predetermined amount, as mentioned above, and by biasing the pointer of the indicator 8 to the full-scale position of one side correspondingly, it is possible to prevent that even a wrong sound is indicated to "have the standard value."

It has already been described that the notes to be tuned are selectively changed over by the switch 12. The frequencies of notes which are respectively higher than the basic note by one and two octaves at each set position of the switch 12, are respectively twice and four times as high as the frequency of the corresponding basic note. Accordingly, it will be convenient if tuning for the note of higher octaves than the basic note can be achieved at the same set position of the switch 12. To perform this, for example, signals of frequencies twice and four times as high as the frequency of the basic note and, if necessary, a signal of higher harmonic are superimposed on a signal of the frequency of the basic note, that is, a distorted wave signal containing harmonics, is applied from the oscillator VCO6 to the phase comparator 4, by which tuning for the note of higher octaves than the basic note can be achieved at the same set position of the switch 12.

Figure 2:
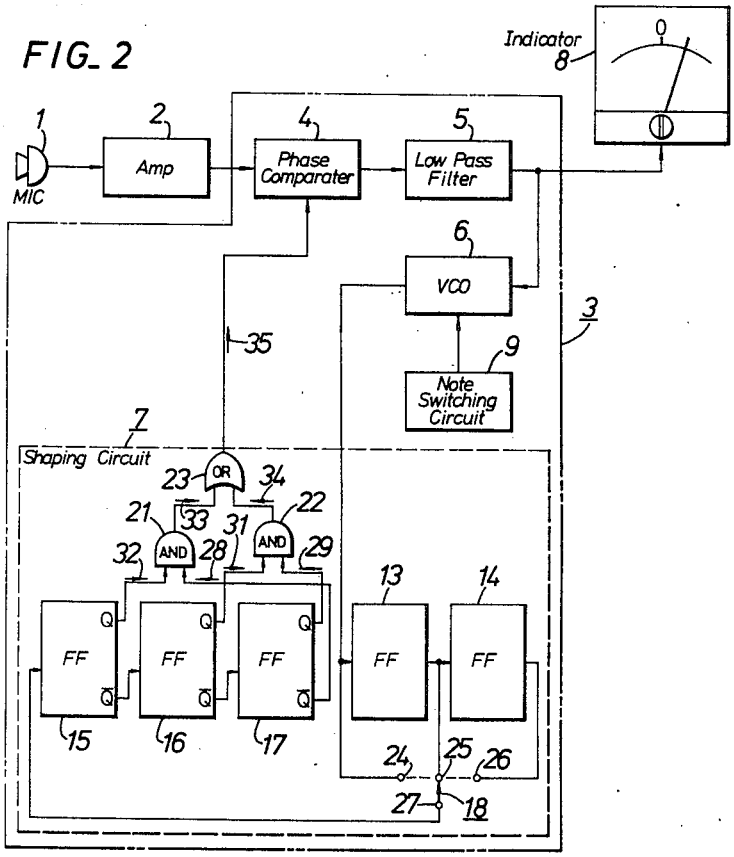
FIG. 2 is a system diagram illustrating another example of this invention.

FIG. 2 illustrates an embodiment of this invention which is designed for the abovesaid purpose. In FIG. 2, parts corresponding to those in FIG. 1 are identified by the same reference numerals. (This also applies to the other drawings.) The output from the oscillator 6 is shaped by a waveform shaping circuit 7 such as a flip-flop circuit into a square wave. The waveform shaping circuit 7 is composed of five flip-flop circuits 13 to 17. The flip-flop circuits 13 and 14 are connected in cascade and the flip-flop circuit 13 is supplied with the output from the oscillator 6. The input and output sides of the flip-flop circuit 13 and the output side of the flip-flop circuit 14 are respectively connected to fixed contacts 24, 25 and 26 of an octave changeover switch 18. By connecting a movable contact terminal 27 of the octave changeover switch 18 to the fixed contacts 24, 25 and 26 one after another, a signal whose frequency changes in a ratio of 1:2:4 can be obtained from the movable contact terminal 27. The signal thus obtained is applied to a trigger input terminal of the first-stage one of the flip-flop circuits 15, 16 and 17 connected in cascade. At two output terminals of the flip-flop circuit 17 of the final stage, there are derived such rectangular waves 28 and 29 as shown in FIGS. 3A and 3B which are frequency divided to $\frac{1}{8}$ and opposite in phase to each other. If the frequency of the rectangular waves 28 and 29 is taken as a fundamental frequency $f_1$, a rectangular wave 31 such as shown in FIG. 3C which has a frequency $f_2$ twice the fundamental frequency $f_1$ can be obtained at the output of the flip-flop circuit 16 of the stage preceding the flip-flop circuit 17. And, at the output of the flip-flop circuit 15, a rectangular wave 32 can be derived which has a frequency $f_4$ four times the fundamental frequency $f_1$ as shown in FIG. 3D. The rectangular waves 28 and 32, and 29 and 31 are respectively AND'ed with each other in AND circuits 21 and 22, by which a discontinuous rectangular wave 233 containing the fundamental frequency $f_1$ and the frequency $f_4$, shown in FIG. 3E, is derived from the AND circuit 21 and a rectangular wave 234 containing the fundamental frequency $f_1$ and the frequency $f_2$, shown in FIG. 3F, is derived from the AND circuit 22. The outputs from the AND circuits 21 and 22 are OR'ed with each other in an OR circuit 23 and its output is supplied to the phase comparator 4. That is, the phase comparator 4 is supplied with such a signal 235 as depicted in FIG. 3G which contains the fundamental frequency $f_1$ and the frequencies $f_2$ and $f_4$. Consequently, in the phase comparator 4, musical sound signals of the three frequencies $f_1$, $f_2$ and $f_4$ can be compared with one another at the same time. Namely, three notes of sequentially different octaves can be tuned at one set position of each of the note changeover switch 12 and the octave changeover switch 18. Further, by switching the changeover switch 18, the tuning range can be shifted twice for each octave. Accordingly, with the embodiment of FIG. 2, it is possible to tune all notes within the range of five octaves in all.

FIG. 4 illustrates a modified form of the FIG. 2 embodiment for tuning notes of different octaves with the switch 12 being held at one set position. The FIG. 4 embodiment employs a plurality of phase comparators $4_1$, $4_2$, $4_3$, . . . and $4_n$, whose input terminals are connected together to the output side of the amplifier 2. To the output sides of the phase comparators $4_1$ to $4_n$ are respectively connected low-pass filters $5_1$ to $5_n$, the output terminals of which are connected together to the indicator 8 and the control input terminal of the oscillator VCO6, respectively. The waveform shaping circuit 7 is composed of a cascade connection of $n$ flip-flop circuits, from which signals of frequencies $f_1$, $f_2$, $f_3$, . . . and $f_n$ are respectively derived and then applied to the phase comparators $4_1$ to $4_n$. With the construction of this example, $n$ scales of different octaves can be tuned at one set of the note changeover switch 12. In addition, since the signals of the frequencies ranging from $f_1$ to $f_n$ are applied in the form of continuous waves to the phase comparators $4_1$ to $4_n$ unlike in the example of FIG. 4, the phase lock loop 3 operates stably. Further, since the low-pass filters $5_1$ to $5_n$, each corresponding to one octave, can be provided, the frequency draw-in range of the oscillator VCO6 can be made equal for each octave. This prevents dispersion in the indication range of the indicator 8 according to octave. Namely, in the case where one low-pass filter 5 is used in common to signals of frequencies different three octaves from each other as described previously with regard to FIG. 2, the frequency draw-in range of the oscillator 6 varies with the frequency of the input musical sound. For example, even if the frequency draw-in range is ±70 percent in the case of a signal of lower frequency, the range sometimes becomes ±40 percent in the case of a signal of higher frequency. However, the construction of FIG. 4 is free from such diadvantage.

Figure 5:
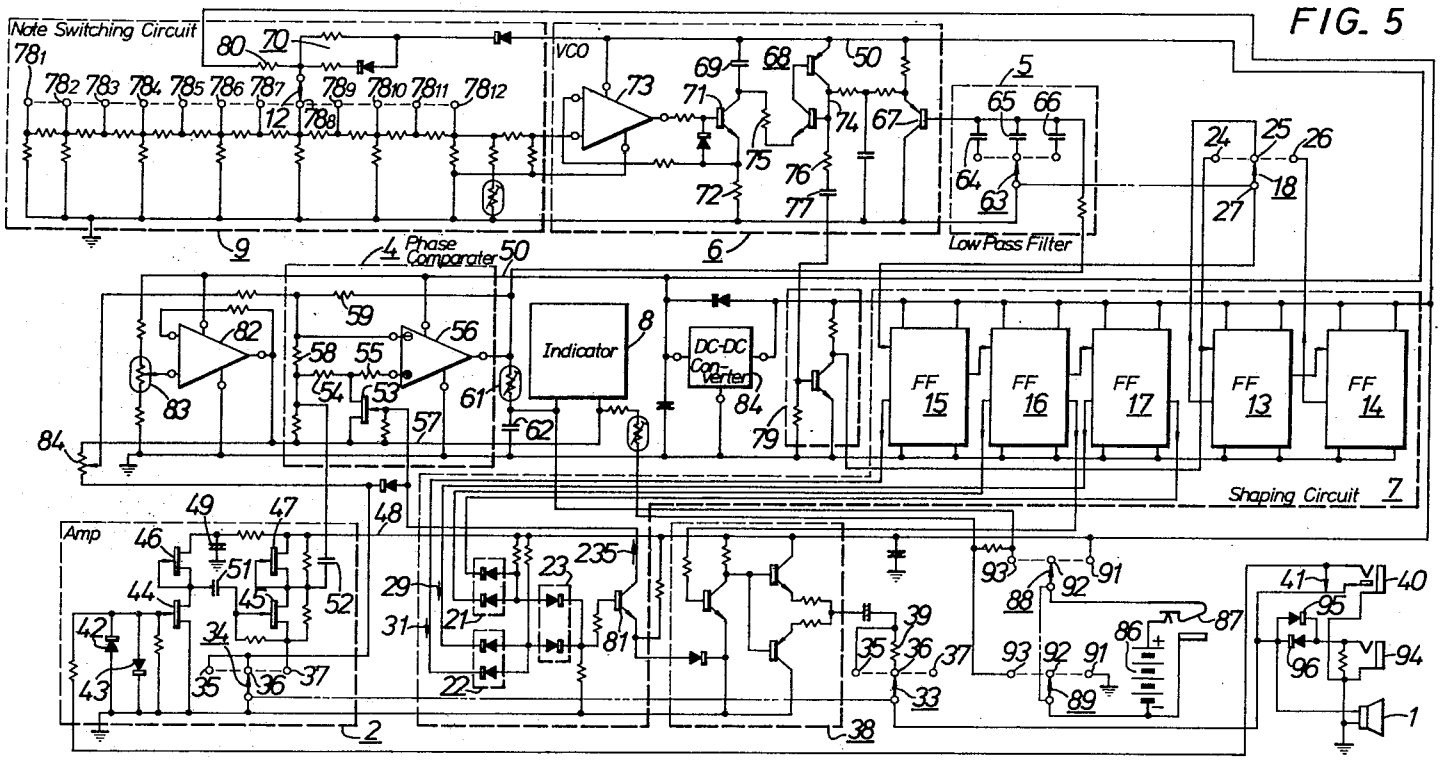
FIG. 5 is a circuit diagram illustrating the detailed construction of the example of FIG. 2.

FIG. 5 shows a concrete construction of the embodiment described above in connection with FIG. 2. In FIG. 5, the microphone 1 is used as a speaker, too, and is adapted to be changed over by ganged mode changeover switches 33 and 34 to the case of causing the indicator 8 to indicate a frequency deviation of a musical sound and to the case where the oscillation signal of the oscillator 6 is produced as a standard sound of each scale note to enable the player to compare an actual musical sound with the standard sound for detecting the frequency deviation. When the movable contact of each of the mode changeover switches 33 and 34 is connected to either one of its fixed contacts 35 and 36, the abovesaid standard sound is produced from the speaker 1 and when the movable contact is connected to another fixed contact 37, the frequency deviation of the musical sound is indicated by the indicator 8. The difference between the fixed contacts 35 and 36 is whether the standard sound produced from the speaker 1 is loud or not. When the contact 36 is selected, a resistor 39 is inserted between the output of a speaker driving amplifier 38 and the speaker 1, by which the level of the sound is attenuated about $\frac{1}{2}$ as compared with that when the contact 35 is selected. The combination speaker-microphone 1 is always connected to the input side of the low-frequency amplifier 2 through a switch contact 41 of an external microphone jack 40. To the input side of the low-frequency amplifier 2 is connected a parallel circuit of two diodes 42, 43 connected in opposite directions to each other. This parallel circuit serves as a limiter with respect to an excessive input to protect amplifier active elements, which are two field effect transistors 44 and 45 in this example. As load resistors of these field effect transistors 44 and 45, resistance elements that the gate electrodes of field effect transistors 46 and 47 are respectively to their source electrodes are employed. To the gate of the field effect transistor 44 is supplied a musical sound signal converted by the combination speaker-microphone 1 into an electrical signal, and the source of the transistor 44 is grounded and the drain is connected to a positive power source line 48 through the field effect transistor 46 serving as the resistance element and a decoupling circuit 49. The gate of the field effect transistor 45 of the next stage is supplied with the amplified output from the field effect transistor 44 of the preceding stage through a capacitor 51. The source of the field effect transistor 45 is connected to the fixed contact 37 of the mode changeover switch 34 and the drain is connected to the positive power source line 48 through the field effect transistor 47 serving as the resistance element. The amplified output from the field effect transistor 45 is supplied to the phase comparator 4 through a capacitor 52. With such an arrangement, only when the mode changeover switch 34 is connected to the fixed contact 37, the low-frequency amplifier 2 operates to supply the phase comparator 4 with the musical sound signal converted by the combination speaker-microphone 1. The low-frequency amplifier 2 performs as a saturation amplifier and the musical sound signal, which is supplied to the phase comparator 4 through the capacitor 52 is rendered into a rectangular wave having a duty ratio of ½.

The phase comparator 4 is comprised of a field effect transistor 53 performing a switching operation, resistors 54 and 55 and a differential amplifier 56 and operates at a voltage $+V_{cc}$ that the voltage of a battery 86 is boosted by a DC/DC converter 84 and supplied to a line 50. The field effect transistor 53 is connected between the junction of a series circuit of the resistors 54 and 55 and a line 57 of $\frac{1}{2}V_{cc}$. The line 57 of $\frac{1}{2}V_{cc}$ is impressed with a voltage $\frac{1}{2}V_{cc}$ that the voltage Vcc of the line 50 is divided by a differential amplifier 82 to ½. The gate of the transistor 53 is supplied with an output signal 235 (refer to FIG. 3G) from the waveform shaping circuit 7. The input musical sound signal is applied from one end of the resistor 54 to a non-inverting input terminal ⊕ of the differential amplifier 56 through the resistors 54 and 55 and, at the same time, to an inverting input terminal ⊖ of the differential amplifier 56 through a resistor 58. Between the inverting input terminal ⊖ and the output end of the differential amplifier 56 is connected a resistor 59 of the same resistance value as that of the resistor 58 to provide a negative feedback to retain the amplification degree of the differential amplifier 56 at 1.

When the field effect transistor 53 is in the on state, the differential amplifier 56 is actuated as an inverting amplifier and when the former is in the off state, the latter is actuated as a non-inverting amplifier. After all, the output from the differential amplifier 56 is normally retained at the voltage ½Vcc. When the frequency of the input musical sound signal is in agreement with any one of the frequencies $f_1$, $f_2$ and $f_4$ contained in the switching signal 235 of the field effect transistor 53, the resulting phase compared output concerning that signal $f_1$, for example, is provided in the form of a rectangular wave of a duty ratio ½ about ½Vcc and the other frequencies, $f_2$ and $f_4$ appear, as they are, at the output side of the differential amplifier 56. Accordingly, the output from the differential amplifier 56 remains unchanged in DC and is equivalent to ½Vcc. This output voltage is fed to one terminal of the indicator 8 through a smoothing circuit composed of a resistor 61 and a capacitor 62. The other input terminal of the indicator 8 is supplied with the voltage ½Vcc from the line 57 of the voltage ½Vcc. Consequently, when any one of the switching frequencies $f_1$, $f_2$ and $f_4$ of the field effect transistor 53 and the frequency of the input musical sound signal are coincident with each other, the pointer of the indicator 8 does not deflect. Where the indicator 8 is the double-deflection indicator described previously with regard to FIGS. 1 and 2, the pointer registers zero to indicate the coincidence of the input musical sound signal with any one of the standard frequencies $f_1$, $f_2$ and $f_4$. On the other hand, in the case where the frequency of the input musical sound signal is a litter higher than any one of the switching frequencies $f_1$, $f_2$ and $f_4$ of the field effect transistor 53 and frequencies $f_1-f_1$, $f_i-f_2$ and $f_i-f_4$ of the differences between the frequency $f_i$ of the input musical sound signal and the respective switching frequencies $f_1$, $f_2$ and $f_4$ can pass through the low-pass filter 5, the output waveform from the differential amplifier 56 becomes such that the width of waveform swinging in the positive direction about ½Vcc is large and the DC mean value is biased positive with respect to ½Vcc. The amount of biasing is in proportion to the ratio of the frequency of the input musical sound signal to the switching frequency of the field effect transistor 53 and the deviation voltage value is supplied to the indicator 8, causing its pointer to deflect in the positive direction. Further, in the event that the frequency of the input musical sound is a little lower than any one of the switching frequencies $f_1$, $f_2$ and $f_4$ of the field effect transistor 53 and that frequencies $f_1-f_i$, $f_1-f_2$ and $f_4-f_i$ of the differences between the frequency $f_i$ of the input musical sound signal and the switching frequencies $f_1$, $f_2$ and $f_4$ can pass through the low-pass filter 5, the output waveform from the differential amplifier 56 becomes such that the width of the waveform swinging in the negative direction about ½Vcc is large and the DC mean value is biased negative with respect to ½Vcc. As a result of this, the pointer of the indicator 8 deflects in the negative direction by an amount proportional to the ratio of the frequency of the input musical sound signal to the switching frequency of the field effect transistor 53. Thus, the circuit interconnecting the phase comparator 4 and the indicator 8 is formed.

The deviation signal obtained with the phase comparator 4 is supplied to the oscillator 6 through the low-pass filter 5 forming one part of the phase lock loop. The low-pass filter 5 is adapted such that capacitors 64, 65 and 66 are changed over by a switch 63 ganged with the octave changeover switch 18 at every switching of the tuning range to thereby raise the cutoff frequency of the low-pass filter at every shifting of the tuning frequency.

The voltage-controlled oscillator VCO6 comprises a PNP-type transistor 67 of the emitter follower construction for amplifying the deviation signal obtained with the phase comparator 4, a switching element 68 of the unijunction transistor construction formed by the combination of a PNP-type transistor with an NPN-type transistor, a capacitor 69 forming an oscillation time constant circuit, a transistor 71 connected in series to the capacitor 69 and serving as a variable resistance element, a resistor 72 connected between the emitter of the transistor 71 and the ground, and an impedance changing amplifier 73 for controlling the base current of the transistor 71 in response to the changeover of the note switching circuit 9. In the switching element 68, the collector of the PNP-type transistor and the base of the NPN-type transistor are connected to each other and this connecting point is used as a control terminal 74. The base of the PNP-type transistor is connected to the collector of the NPN-type transistor and the emitter of the PNP-type transistor is connected to the power source line 50 and, further, the emitter of the NPN-type transistor is connected to the connecting point of the capacitor 69 and the transistor 71 through a resistor 75 of sufficiently small resistance value, for example, 10 ohms.

At the instant when the charging voltage of the capacitor 69 has gradually increased and the collector potential of the transistor 71 has become lower than the potential at the control terminal 74, the switching element 68 conducts to discharge therethrough the charge stored in the capacitor 69. Accordingly, where the control terminal 74 is held at a certain potential, the switching element 68 performs a switching operation with a certain repetition period, providing a pulse signal of small pulse width at the control terminal 74 at every conduction of the switching element 68. The deviation signal in the phase comparator 4 is biased in the positive direction with respect to $+\frac{1}{2}$Vcc and this deviation signal is applied to the control terminal 74 of the switching element 68 to lower a discharge starting voltage of the capacitor 69, by which the on-off repetition period of the switching element 68 is made short to raise its oscillation frequency. When the deviation signal changes in the negative direction with respect to $+\frac{1}{2}$Vcc, it is applied to the control terminal 74 to increase the discharge starting voltage of the capacitor 69, with the result that the on-off repetition period of the switching element 68 becomes longer and the oscillation frequency is controlled to lower.

It is possible to apply a resistance ladder network to the note switching circuit 9. The movable contact of the note changeover switch 12 is supplied with the voltage +Vcc from the power source line 50 through a temperature compensation circuit 70. A resistor 80 is a resistor for power source voltage compensation, through which the voltage of a battery 86 is supplied to the movable contact of the switch 12. The positive power source voltage +Vcc can be switchingly supplied to respective resistance dividing points of the resistance ladder network through fixed contacts $78_1$ to $78_{12}$. By connecting the switch 12 to the fixed contacts in a sequential order of $78_1$, $78_2$, . . . and $78_{12}$, there is derived at the output terminal of the resistance ladder network a note switching signal which gradually approaches the power source voltage Vcc in a stairstep manner. This note switching signal is supplied to the non-inverting input terminal ⊕ of the impedance changing amplifier 73 provided in the oscillator VCO6, by which the output current from the amplifier 73 is gradually increased in a stairstep manner. At the same time, the resistance value between the collector and emitter of the transistor 71 gradually decreases in a stairstep manner and the charging time constant of the capacitor 69 gradually decreases correspondingly. By such changeover of the note changeover switch 12, the oscillation frequency of the oscillator 6 is brought in agreement with the standard tuning frequency of each of notes C, C♯, D, D♯, E, F, F♯, G, G♯, A, A♯ and B.

By sequentially applying the same voltage to the connection points of the respective series resistors of the resistance ladder circuit shown in FIG. 5, a logarithmically changing voltage is obtained at one terminating end of the ladder circuit which voltage can, as described above, cause the reference oscillator to oscillate at any one of 12 standard tuning frequencies. In the embodiment of the invention shown in FIG. 1 where a similar result is accomplished by use of 12 switched resistors $11_1$–$11_{12}$, the different resistance values of each of said resistors $11_1$–$11_{12}$ must be carefully set, and this imposes certain difficulties in the manufacture of the tuner. In contrast, the resistance ladder circuit shown in FIG. 5 can be formed with series resistors that all have the same resistance value, and with parallel resistors which also have the same resistance value. Use of the resistance ladder circuit shown in FIG. 5 to effect changes in the oscillation frequency of the reference oscillator, in place of the array of differing-value resistances shown in FIG. 1, therefore simplifies manufacture of the tuner.

The oscillation output signal from the oscillator VCO6 is derived at the control terminal 74 of the switching element 68 through a resistor 76 and a capacitor 77 and is supplied to the waveform shaping circuit 7 through a buffer amplifier 79. The waveform shaping circuit 7 comprises the two flip-flop circuits 13 and 14 for the octave switching use, the octave changeover switch 18, the three flip-flop circuits 15, 16 and 17, and the two AND circuits 21 and 22 for obtaining the logical products of the signals of the frequencies twice and four times the fundamental frequency $f_1$ and one OR circuit 23, as described previously in connection with FIG. 2. At the output of the OR circuit 23 is obtained the signal 235 having the waveform shown in FIG. 3G. By this waveform signal 235, a transistor 81 is turned on and off and, in turn, by the on-off operation of the transistor 81, the switching field effect transistor 53 is turned on and off.

A potentiometer 83 is provided for such an adjustment that the output voltage of a differential amplifier 82 may become $\frac{1}{2}$Vcc. That is, in the case where the oscillation signal of the oscillator VCO6 is emitted from the speaker 1, a control voltage applied to the oscillator VCO6 is changed by the potentiometer 83, by which the frequency of the sound emanating from the speaker 1 is slightly varied. A jack 87 is to receive a plug for the external power source connection. Upon insertion of the plug in the jack 87, a built-in battery 86 is disconnected from the circuit. When power source switches 88 and 89 are connected to a fixed contact 91, the tuner is put in its operative state and when the switches are connected to a contact 92, the tuner is altered to its inoperative state. And when the switches are connected to a contact 93, the voltage of the battery 86 is supplied to the indicator 8 to enable checking of the voltage of the battery 86. A jack 94 is provided for supplying an amplifier or the like with the signal of the standard tuning frequency of each scale to be emitted from the speaker 1. Where an input terminal of such an amplifier or the like is connected to the jack 94, there is the likelihood that the built-in speaker 1 serves as a microphone. To avoid this, a reverse parallel circuit of diodes 95 and 96 connected in opposite direction to each other is inserted between the speaker 1 and the jack 94 to prevent turning on of the diodes 95 and 96 with a voltage such as the starting voltage of the speaker 1. And, by the threshold levels of the diodes 95 and 96, the speaker 1 is insulated from the input terminal of the external amplifier. This prevents the sound emanating from a speaker of the external amplifier from being fed back to the speaker 1 to cause howling.

Figure 6:
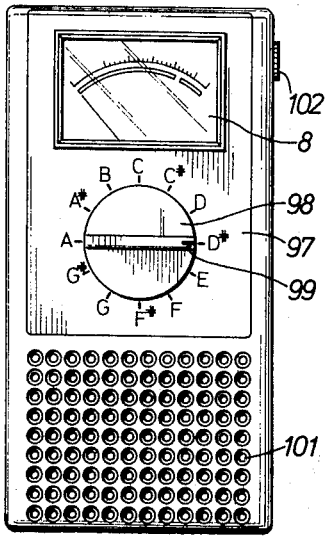
FIG. 6 is a front view showing one example of the external appearance of the tuner of this invention.
Figure 7:
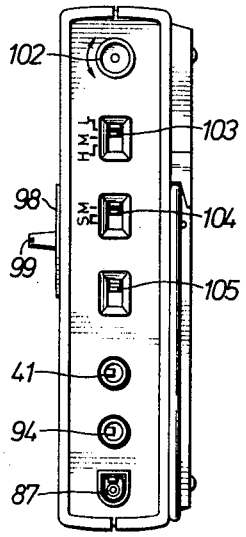
FIG. 7 is its side view.

The tuner described above with reference to FIG. 5 can be housed in such a case 97 as shown in FIGS. 6 and 7. FIG. 6 is a front view of the case 97 and FIG. 7 its side view. The case 97 is made of a resinous material in a flat and rectangular configuration. The indicator 8 is mounted on the flat front surface of the case at one end portion thereof and a knob 98 of the note changeover switch 12 is disposed at the center of the front surface. The note changeover switch 12 is a rotary switch and the knob 98 is rotatable step by step in an endless manner. The knob 98 has a index 99 indicating the rotational position of the knob 98. On the surface of the case 97, there are provided note indications C, C#, D, D#, E, F, F#, G, G#, A, A# and B along the direction of rotation of the index 99. At the other end portion of the front surface, many small holes are formed in the case 97 to provide a section 101 for housing the combination speaker-microphone 1. One side of the case 97 has disposed thereon a knob 102 of the variable resistor 84 for controlling the frequency of the sound emitted from the speaker 1, a knob 103 of the octave changeover switch 18, a knob 104 of the mode changeover switches 33 and 34, a knob 105 of the power source switches 88 and 89, an input jack 40 for the connection with an external microphone, the output jack 94 for the connection with an external amplifier, and the input jack 87 for the connection with an external power source.

As described above, with the tuner of this invention, the procedure of preparation for the visual detection of the frequency deviation of a musical instrument by the indicator 8 is as follows: At first, the knob 105 of the power source switches 88 and 89 is moved to its on position, and the knob 104 is switched in the direction for the mode changeover switches 33 and 34 to select the fixed contact 37 and then the knob 98 of the note changeover switch 12 is turned to bring the index 99 in alignment with the indication of the note desired to tune, for example, C. Under such conditions, a frequency deviation of the sound of C produced by the musical instrument is indicated by the indicator 8. At this time, if the octave changeover switch 18 is connected with the fixed contact 26 and if its fundamental frequency is 130.81Hz, notes $C_4$ = 261.63Hz and $C_5$ = 523.25Hz, which are respectively higher one and two octaves than the note C, can be tuned with the note changeover switch 12 held at its initially set position. Thus, according to this invention, once the tuner has been set for tuning, erroneous tuning of the musical instrument can be directly indicated on the indicator 8 without touching the tuner. This is highly convenient for actual tuning.

Figure 8:
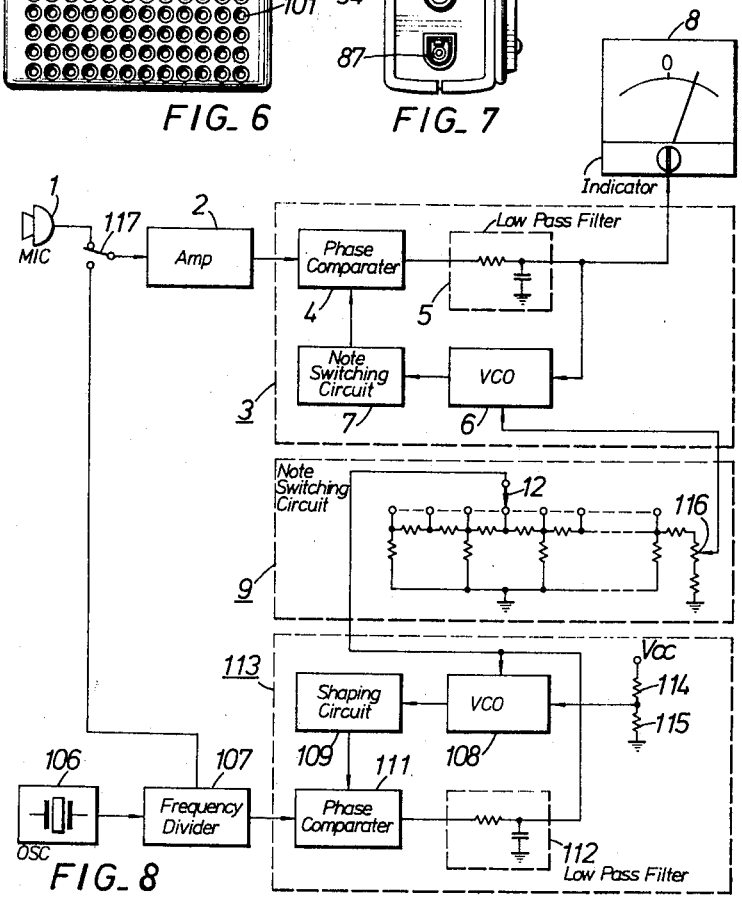
FIG. 8 is a system diagram illustrating another example of the tuner of this invention employing temperature compensating means.

FIG. 8 illustrates another embodiment of this invention, which is designed for the compensation for a drift of the oscillation frequency of the voltage-controlled oscillator VCO6 which is caused by a temperature change or power source voltage fluctuation. That is, a fixed oscillator 106 of high stability such, for example, as a crystal oscillator, a frequency divider 107 for frequency dividing its output, a second voltage-controlled oscillator 108 of the same construction as the aforesaid oscillator VCO6, a waveform shaping circuit 109, a phase comparator 111 and a low-pass filter 112 are added to the tuner described in the foregoing. The second oscillator 108, the waveform shaping circuit 109, the phase comparator 111 and the low-pass filter 112 make up a second phase lock loop 113. The second phase lock loop 113 is supplied with the signal that the oscillation signal of the crystal oscillator 106 is frequency divided to a suitable frequency, for example, 440Hz and the oscillator 113 is thereby locked at the frequency. The second oscillator 108 is supplied with a constant bias voltage from a voltage divider circuit composed of resistors 114 and 115, by which the oscillator 108 is caused to oscillate, for example, at the same frequency as that 440Hz of the frequency divided output signal from the frequency divider 107.

Assume that the oscillation frequency of the first oscillator VCO6 varies for example, higher due to, for example, a temperature change, power source voltage fluctuation, secular variation of the element constant of the oscillation time constant circuit or the like. If a correctly tuned musical sound is applied, the pointer of the indicator 8 deflects to the negative side to indicate that the sound is deviated lower. At the same time, it is indicated that the oscillation frequency of the oscillator VCO6 is deviated lower. Assuming that the oscillation frequency of the oscillator VCO6 is deviated higher, it is indicated that the frequency of the correctly tuned sound is deviated higher. On the other hand, since the second voltage-controlled oscillator 108 is identical in construction with the first one VCO6, the frequency variation of the former is substantially the same as that of the latter. Accordingly, since the phase comparator 11 compares the frequency of the oscillation signal of the fixed oscillator 106 supplied through the frequency divider 107 with the frequency of the oscillation signal of the oscillator VCO108, if the oscillation frequency of the oscillator VCO108 is assumed to rise, for example, by $+\Delta f$Hz, there is produced in the phase lock loop 113 such a signal equivalent to that the input signal is deviated lower by $\Delta f$Hz. Consequently, the output from the phase comparator 111 is biased in the negative direction from its initial output voltage by a voltage corresponding to the deviation $\Delta f$Hz. Conversely, if the oscillation frequency of the oscillator VCO108 is lowered by $-f$Hz, the output from the phase comparator 111 is biased in the positive direction from its initial value by a voltage corresponding to $\Delta f$Hz. Therefore, if this compensation voltage is applied to the oscillator VCO6 through the movable contact of the note changeover switch 12 and the note changeover circuit 9, when the oscillation frequency of the oscillator VCO6 rises, the phase comparator 111 produces a negative-biasing compensation voltage, so that the oscillation frequency of the oscillator VCO6 is corrected to be lowered down to its normal value. Further, when the oscillation frequency of the oscillator VCO6 is deviated lower, the phase comparator produces a positive-biasing compensation voltage, and the oscillation frequency of the oscillator VCO6 is raised to be corrected to its normal value. In short, the stability of the oscillation frequency of the oscillator VCO6 is substantially the same as that of the oscillation frequency of the fixed oscillator to ensure compensation of extremely high stability.

Consequently, with such a construction employing the fixed oscillator 106 and the second phase lock loop 112 and correcting the oscillation frequency of the oscillator VCO6 with a compensation voltage obtained from the second phase lock loop 113 in proportion to frequency deviations of the oscillators VCO6 and VCO108, the oscillation frequency of the oscillator VCO6 is stabilized with high accuracy to provide for enhanced reliability in tuning.

Figure 9:
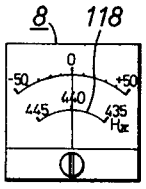
FIG. 9 is a front view showing one example of a scale of an indicator for use in the tuner of this invention.

In actual musical performances, the standard note $A_4$ is selected to be 440Hz, 435Hz or 445Hz. Since this standard note differs with orchestras, it is not practical if the standard tuning frequency of the note selected for tuning cannot be changed at will. To meet this requirement, a potentiometer 116 is connected to the output side of the note switching circuit 9 so that the voltage value of the note switching signal switched in a stairstep manner is supplied to the oscillator VCO6 through movable member of the potentiometer 116, as shown in FIG. 8. Accordingly, by moving the movable member of the potentiometer 116, the standard tuning frequency of each note is raised or lowered little by little. In order to indicate the amount of such frequency shift, it is arranged that a highly reliable signal of, for example, 440Hz corresponding to the frequency of note $A_4$ can be supplied by the switching of a switch 117 from the frequency divider 107 to the low-frequency amplifier 2 and, by the adjustment of the movable member of the potentiometer 116 during the application of the signal of 440Hz to the low-frequency amplifier 2, the amount of frequency shift can be indicated on the indicator 8. Namely, the note changeover switch 12 is changed over to A and the signal of 440Hz is supplied to the low-frequency amplifier 2 through the switch 117. At this time, if the indicator 8 registers zero, the standard tuning frequency of the tuner is 440Hz. In this case, by moving the movable member of the potentiometer 116, it is possible to deflect the pointer of the indicator 8 in the positive and negative directions. If the potentiometer 116 is adjusted by its movable member in such a manner as to deflect the pointer to the positive side, the oscillation frequency of the oscillator VCO6 is shifted to the lower side. And when the potentiometer 116 is so adjusted as to deflect the pointer to the negative side, the oscillation frequency of the oscillator VCO6 is shifted to the higher side. Accordingly, it is sufficient only to provide such a frequency calibration graduation 118 (see FIG. 9) and to make such an adjustment that when the oscillator VCO6 oscillates at the frequencies 435 and 445Hz respectively, the pointer indicates 435 and 445Hz respectively.

With such an arrangement, it is possible to achieve accurate tuning whether the standard tuning frequency is selected to be 440, 435 or 445Hz. The means for shifting the oscillation frequency of the oscillator VCO6 need not always be the potentiometer but may also be a resistor of a preset resistance value. Further, it is also possible to indicate that the standard tuning frequency selected is 440, 435 or 445Hz according to the position of the switch. Moreover, the frequency shifting means need not always be provided at the output side of the note switching circuit 9 but may be disposed at some other positions. For example, it is also possible to employ such an arrangement that the capacitor 69 or the resistor 72 (see FIG. 5) for determining the oscillation constant of the oscillator 6 is changed over by a switch.

Figure 10:
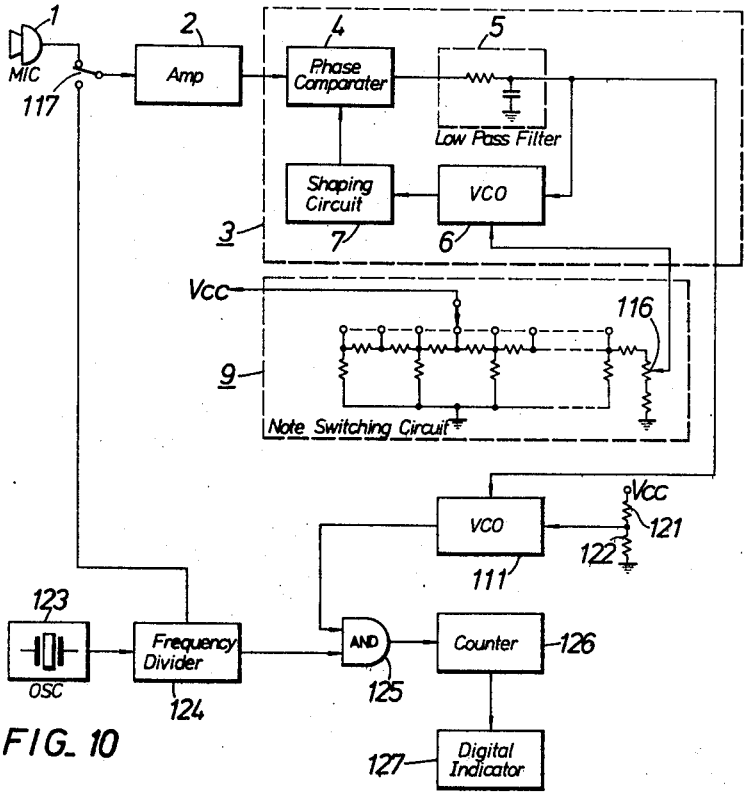
FIG. 10 is a system diagram showing another example of this invention employing a digital indicator.

FIG. 10 shows still another embodiment of this invention, which is adapted to indicate the frequency deviation by a digital indicating means in place of the indicator 8. That is, the output of the tuner shown, for example, in FIG. 5, from the low-pass filter 5 is supplied not to the indicator 8 but to a second voltage-controlled oscillator VCO119 of the same construction as the first one VCO6, by which the oscillators VCO6 and VCO119 are controlled by the same control voltage. The oscillation frequency of the oscillator VCO119 is set by a voltage dividing circuit composed of resistors 121 and 122, for example, at 440Hz. And this frequency is varied about 440Hz by the control signal supplied from the low-pass filter 5. Accordingly, the amount of the frequency fluctuation follows the frequency of the input musical sound signal applied from the microphone 1. On the other hand, for example, a crystal oscillator 123 of stable oscillation frequency and a frequency divider 124 for frequency dividing the oscillation signal of the oscillator 123 to an appropriate frequency are provided, by which a gate signal having a pulse width of, for example, 0.5 sec. is obtained from the frequency divider 124. By controlling a gate circuit 125 with the gate signal to open and close it, the oscillation signals of the oscillator VCO119, which are each gated for 0.5 sec. are derived at the output side of the gate circuit 125. The gated outputs are counted by a counter 126 and the counted value is indicated by a digital indicator 127. The counter 126 is reset immediately before the gate circuit 125 is opened by each gate signal. By the employment of such an construction that the signal of, for example, the standard tuning frequency 440Hz of $A_4$ or a signal of the standard tuning frequency of another note is obtained from an appropriate frequency divided frequency of the frequency divider 124 and is appropriately applied through the switch 117 to the low-frequency amplifier 2, it is also possible to calibrate the tuner. For this calibration, it is also possible, for example, to insert a potentiometer between the resistors 121 and 122 supplying a bias voltage to the oscillator VCO119 and to supply the bias voltage from the movable member of the potentiometer to the oscillator VCO119 for a fine control of its oscillation frequency. Further, the potentiometer 116 provided at the output side of the note switching circuit 9 may also be utilized.

Figure 11:
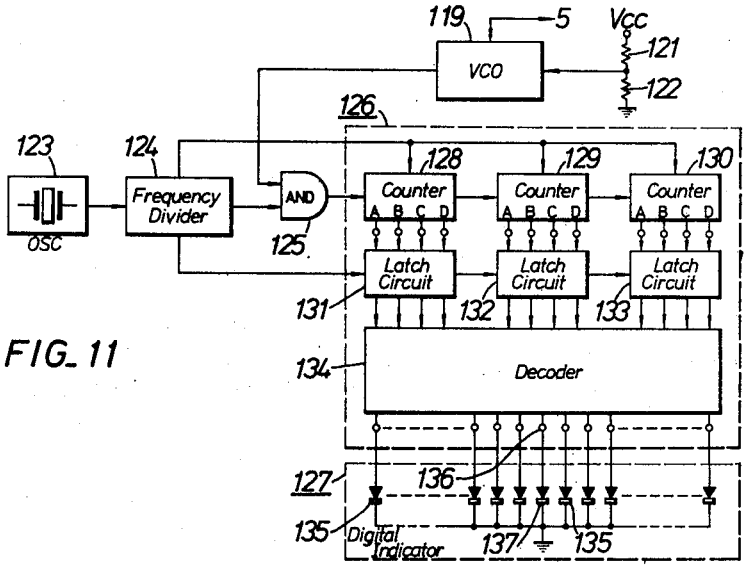
FIG. 11 is a system diagram for explaining the construction of the digital indicator.

The digital indicator 127 may be designed to indicate the oscillation frequency of the oscillator VCO119 according to a known numeral indication system. However, in view of the fact that the tuner is used for tuning of all the notes, it is preferred to adopt such an indication system as depicted in FIG. 11. Namely, the oscillation signal of the oscillator VCO119 is gated by the gate circuit 125 for a certain period of time and then applied to the counter 126. The counter 126 is composed of a cascade connection circuit of decimal counters 128, 129 and 130, latch circuits 131, 132 and 133 for holding the counted values of the decimal counters 128 to 130 at every gating, and a decoder 134 for decoding the contents of the latch circuits. That is, the outputs derived at respective output terminals A, B, C and D of the decimal counters 128, 129 and 130 are supplied to the decoder 134 through the latch circuits 131, 132 and 133, respectively, and an output voltage is derived at any one of a plurality of output terminals of the decoder 134 in accordance with the numerical values counted by the decimal counters 128, 129 and 130. The decoder 134 has, for example, about 20 to 30 output terminals, to which are respectively connected a plurality of light emission diodes 135 forming the digital indicator 127. The plurality of light emission diodes 135 are disposed along a scale graduated in percent and the light emission diode 135 connected to the output terminal 136 of the decoder 134 at the center thereof is disposed at the position of the graduation of zero percent. Consequently, when the sound is of a correct frequency, the light emission diode 137 is lighted, and the position of a different light emission diode which is lit relative to the central light emission diode 137 indicates an upward or downward frequency deviation in percent. The indicator 127 is not limited specifically to the use of light emission diodes but may employ other light emission elements.

With such an indication method, the frequency deviation of the sound being tuned can be directly viewed from the indication, so that misinterpretation of the indication is not likely to occur. Further, an erroneous indication due to frequency floating of the oscillator VCO6 can be corrected by the frequency floating of the oscillator VCO119.

The reason therefor will hereinbelow be described. Let it be assumed that the oscillation frequency of the first voltage-controlled oscillator VCO6 rises $\Delta f$, for example, due to a temperature rise. In this case, the frequency of a correctly tuned musical sound is indicated to be deviated downwardly by $\Delta f$ relative to the reference. Accordingly, the output voltage from the low-pass filter 5 becomes a voltage biased in the negative direction with respect to the reference value. Since this output voltage is applied to the oscillator VCO119, the oscillate VCO119 tends to oscillator at a frequency shifted downwardly by $\Delta f$. However, the oscillator VCO119 is identical in construction with the oscillator VCO9, so that if the oscillation frequency of the oscillator VCO6 rises by $\Delta f$ due to a temperature rise, the oscillation frequency of the oscillator VCO119 also rises by $\Delta f$ due to temperature rise. After all, in the oscillation frequency of the oscillator VCO119, the frequency rise due to the temperature rise and the frequency drop by the control voltage supplied from the low-pass filter 5 cancel each other and, as a result of this, the oscillation frequency of the oscillator VCO119 is stabilized. Accordingly, the oscillation frequency of the oscillator VCO119 is always stablized to be the standard frequency, ensuring accurate tuning untouched by the frequency floating of the oscillator VCO6. Therefore, it is possible to obtain a tuner which allows ease in interpretation of its indication and is highly reliable.

As has been described in the foregoing, the tuner of this invention employs the phase lock loop, and hence, well responds to even a slight frequency difference with high accuracy to enable highly reliable tuning. Further, an electric signal proportional to the ratio of the standard tuning frequency with the frequency of the input musical sound signal can be obtained, so that the amount of frequency deviation can be direct reading indicated by the pointer of the indicator 8. Therefore, it will be understood that the tuner of this invention is very easy to handle and convenient, as compared with conventional tuners of the type in which the strobe frequency is manually synchronized with the frequency of the input musical sound signal and the amount of frequency deviation is detected from the amount of operation needed for the synchronization.

Further, the tuner of this invention can be entirely formed with electrical elements, and hence can be produced at low cost. Moreover, since the deviation signal derived from the low-pass filter 5 is in proportion to the ratio of the frequency of the input musical sound signal to the standard tuning frequency, the amount of frequency deviation can be correctly indicated by the indicator 8 with the scale equally graduated in percent regardless of whether the frequency of the input musical sound signal is high or low and the indication easy to interpret.

What is claimed is:

1. An electronic tuner for musical instruments comprising:

an amplifier for amplifying an input musical signal, said amplifier including means operative to shape said input musical signal into a square wave;

a reference oscillator of the type adapted to have its oscillation frequency controlled by a control voltage to produce a reference oscillation signal of controlled frequency;

a phase comparator coupled to said oscillator and to said amplifier for comparing the amplified musical sound signal in phase with said reference oscillation signal;

a waveform shaping circuit for shaping the oscillation signal from said reference oscillator into a square wave, said waveform shaping circuit comprising a plurality of frequency dividers connected in cascade and supplied with said reference oscillation signal to frequency divide said reference oscillation signal, and an AND gate for obtaining the logical product of the outputs from the frequency dividers and for supplying the phase comparator with said logical product in the form of a signal containing a higher harmonic;

said phase comparator comprising a multiplier for multiplying the square wave musical signal from the amplifier by the output from the waveform shaping circuit;

a low-pass filter for extracting the low-frequency component from the output of said phase comparator and applying it as the control voltage to said reference oscillator; and an indicator connected to the output of said low-pass filter and responsive to said control voltage for providing a direct visual indication of the ratio between said reference oscillation signal and the frequency of said input musical signal.

2. An electronic tuner for musical instruments according to claim 1 wherein said indicator includes a movable pointer, means for deviating said reference oscillation frequency from a correct scale frequency in a manner operative to derive at the output of the phase comparator a voltage which causes said pointer to register with one end of its deflection range in the absence of the input musical signal and to register with the median of its deflection range when the input musical signal is inputted at a correct frequency.

3. An electronic tuner for musical instruments according to claim 1, including means for selectively changing the oscillation frequency of said reference oscillator, a fixed frequency oscillator stably generating a signal of a correct frequency of a certain scale, and a changeover switch for supplying said multiplier with the output from said fixed frequency oscillator in place of said musical signal, said indicator including a graduated scale for indicating the oscillation frequency of the reference oscillator based on the oscillation frequency of the fixed frequency oscillator and the output voltage from the multiplier supplied with the oscillation output from the reference oscillator.

4. An electronic tuner for musical instruments comprising:

an amplifier for amplifying an input musical signal;

a reference oscillator of the type adapted to have its oscillation frequency controlled by a control voltage to produce a reference oscillation signal of controlled frequency;

a waveform shaping circuit comprising a plurality of frequency dividers connected in cascade to frequency divide said reference oscillation signal;

a phase comparator coupled to said oscillator and said amplifier for comparing the amplified musical signal in phase with said reference oscillation signal, said phase comparator comprising a multiplier for multiplying the signal from the amplifier by the output from said waveform shaping circuit;

an octave changeover switch for selectively picking up the output from each frequency divider and the output from the reference oscillator, and so arranged that the output from the octave changeover switch is applied to the first-stage of said cascade connected frequency dividers;

an AND gate for obtaining the logical product of the outputs from the frequency dividers and supplying said logical product to said phase comparator in the form of a signal containing a higher harmonic;

a low-pass filter for extracting the low-frequency component from the output of said phase comparator and applying it as the control voltage to said reference oscillator; and an indicator connected to the output of said low-pass filter and responsive to said control voltage for providing a direct visual indication of the ratio between the frequency of said reference oscillation signal and the frequency of said input musical signal.

5. An electronic tuner for musical instruments according to claim 4 including means for switching the cut-off frequency of said low-pass filter in ganged relation to said octave changeover switch.

6. An electronic tuner for musical instruments comprising:

an amplifier for amplifying an input musical signal;

a reference oscillator of the type adapted to have its oscillation frequency controlled by a control voltage to produce a reference oscillation signal of controlled frequency;

a frequency divider for frequency dividing said reference oscillation signal into a plurality of signals of difference frequencies;

a plurality of phase comparators which are respectively supplied with said different frequency signals and with said amplified input musical signal for comparing the frequency-divided outputs from the frequency divider in phase with said input musical signal;

a plurality of low-pass filters for individually filtering the outputs from the plurality of phase comparators and for applying the low frequency components in the phase comparator outputs as the control voltage to said reference oscillator; and an indicator connected to the outputs of said low-pass filters and responsive to said control voltage for providing a direct visual indication of the ratios between the frequency of said frequency-divided outputs and the frequency of said input musical signal.

7. An electronic tuner for musical instruments comprising:

an amplifier for amplifying an input musical signal;

a reference oscillator of the type adapted to have its oscillation frequency controlled by a control voltage to produce a reference oscillation signal of controlled frequency;

a phase comparator coupled to said oscillator and to said amplifier for comparing the amplified input musical signal in phase with said reference oscillation signal;

a low-pass filter for extracting the low-frequency component from the output of said phase comparator and applying it as the control voltage to said reference oscillator;

an indicator connected to the output of said low-pass filter and responsive to said control voltage for providing a direct visual indication of the ratio between the frequency of said reference oscillation and the frequency of said input musical signal;

a variable frequency oscillator adapted to have its oscillation frequency controlled by a control voltage, said variable frequency oscillator being identical in construction to said reference oscillator;

a relatively stable fixed frequency oscillator;

a second phase comparator for comparing the phases of oscillation signals of the variable frequency oscillator and of the fixed frequency oscillator in phase with each other; and a second low-pass filter supplied with the compared output from the second phase comparator and applying it to a control terminal of the variable frequency oscillator, the filtered output from the second low-pass filter also being applied to the reference oscillator as a control signal to compensate for frequency fluctuation of the reference oscillator.

8. An electronic tuner for musical instruments comprising:

an amplifier for amplifying an input musical signal;

a reference oscillator of the type adapted to have its oscillation frequency controlled by a control voltage to produce a reference oscillation signal of controlled frequency;

a phase comparator coupled to said oscillator and to said amplifier for comparing the amplified input musical signal in phase with said reference oscillation signal;

a low-pass filter for extracting the low-frequency component from the output of said phase comparator and applying it as the control voltage to said reference oscillator;

an indicator connected to the output of said low-pass filter and responsive to said control voltage for indicating the ratio between the frequency of said reference oscillation signal and the frequency of the input musical signal;

a voltage-frequency converter for converting the output voltage from the low-pass filter into a signal having a frequency related to the magnitude of said output voltage;

a counter coupled to said converter for counting the number of cycles of the output signal from said voltage-frequency converter for each unit time; and a plurality of light emitting elements spaced in an array corresponding to scale graduations and selectively lighted by the output from said counter to indicate the ratio between the frequency of said reference oscillation and the frequency of said input musical signal.

* * * * *